United States Patent [19]

Faulkner

[11] 4,314,308

[45] Feb. 2, 1982

[54] INCREASING THE RATE OF NEUTRALIZATION OF STATIC ELECTRICITY

[75] Inventor: James D. Faulkner, Atlanta, Ga.

[73] Assignee: Lester Laboratories, Inc., Atlanta, Ga.

[21] Appl. No.: 194,329

[22] Filed: Oct. 6, 1980

[51] Int. Cl.[3] ..... H05F 3/00

[52] U.S. Cl. ..... 361/212

[58] Field of Search ..... 361/212, 231, 218, 229, 361/215, 214, 225

[56] References Cited

U.S. PATENT DOCUMENTS 3,123,640 3/1964 Longley ..... 361/212
3,888,678 6/1975 Bailey, Jr. et al. ..... 361/212
3,984,731 10/1976 Martin ..... 361/212
4,169,279 9/1979 Friedman, Jr. et al. ..... 361/212

*Primary Examiner*—A. D. Pellinen
*Assistant Examiner*—L. C. Schroeder
*Attorney, Agent, or Firm*—Beveridge, DeGrandi, Kline, Lunsford

[57] ABSTRACT

A process for neutralizing a static electric charge on a surface consists essentially of contacting an atmosphere with at least one aqueous static charge composition by spraying an effective amount of the composition into the atmosphere, and then contacting the resulting treated atmosphere with a surface having static electric charge thereon to thereby neutralize at least a portion of the charge. The static charge composition is prepared from substantially deionized water to thereby increase the rate at which the static charge is neutralized.

18 Claims, 1 Drawing Figure

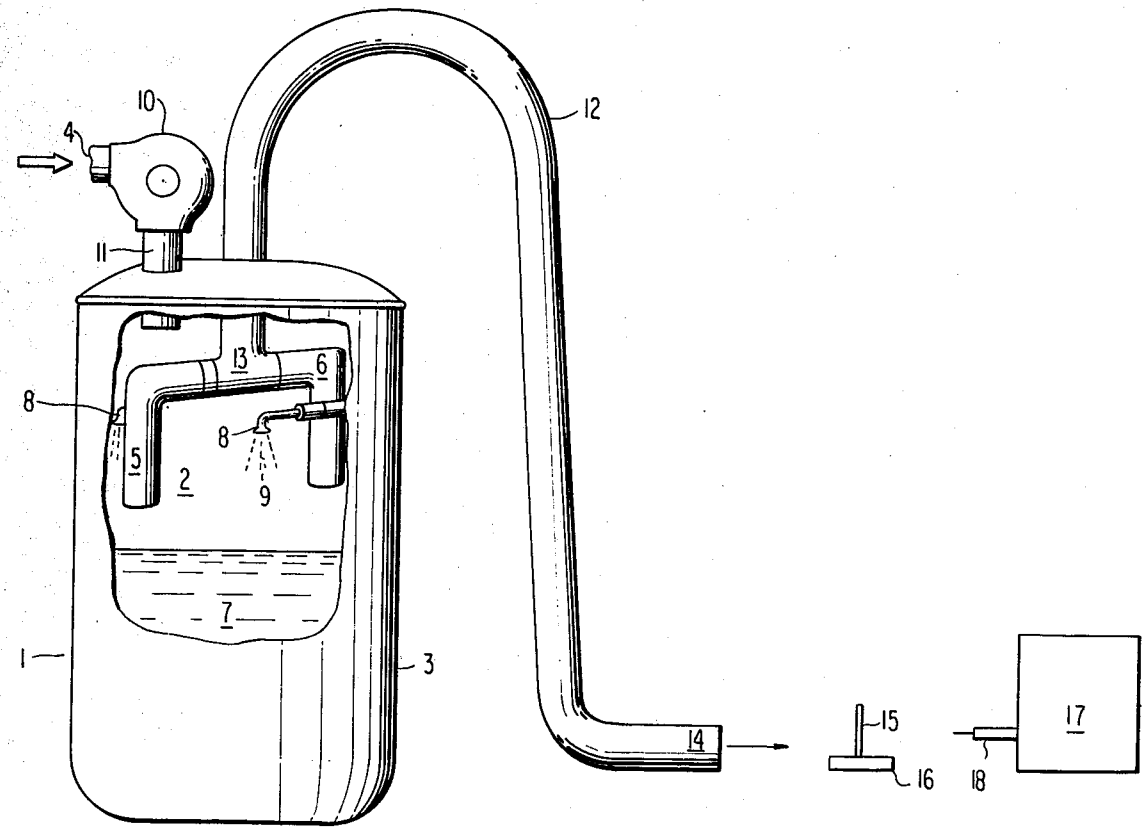
1
2
3
4
5
6
7
8
8
9
10
11
12
13
14
15
16
17
18

INCREASING THE RATE OF NEUTRALIZATION OF STATIC ELECTRICITY

BACKGROUND OF THE INVENTION

This invention relates to a process for increasing the rate of neutralizing positive and negative static electric charges on surfaces. More particularly, static electric charges are neutralized at an increased rate by contacting the surfaces with treated atmospheres formed by spraying aqueous static charge compositions based on deionized water into the atmospheres.

Friction between objects of different molecular structures creates static electric charges. This problem is particularly acute in the textile industry where certain textile processing operations require frictional contact between a yarn and various mechanical devices, such as spindles and capstans. Depending upon the nature of the yarn, positive or negative charges build up and often lead to deleterious consequences. A safe, economical means of controlling both positive and negative static electricity is, therefore, of considerable interest to the textile industry.

Many attempts have been made in the past to neutralize static electricity. One of the approaches commonly employed involves the use of chemical additives, which are introduced into air-wash devices used in textile plants. Such anti-static formulations marketed for use in air-washers are capable of neutralizing either positive static charges, negative static charges, or positive and negative static charges on objects.

U.S. Pat. No. 3,924,157 and U.S. Pat. No. 4,007,914 to Peters and McAmish teach that an aqueous solution of borax and a surfactant can be sprayed into a gaseous stream to impart an electrical charge to the stream. Similarly, U.S. Pat. No. 3,939,080 and U.S. Pat. No. 3,984,731 teach that dodecylbenzyl triethyl ammonium chloride can be added to an air-washer that delivers a flow of air to a room in which static electricity is present. U.S. Pat. No. 4,152,288 to Freidman, Jr., Faulkner and King discloses the use of an aqueous solution of a quaternary ammonium compound and a surfactant in a spray system for the neutralization of both positive and negative static charges on objects. U.S. Pat. No. 4,169,279 to Freidman and Faulkner describes a similar result using mixed atmospheres.

These known processes based on chemical additives have achieved acceptance by industry because of the favorable results obtained. Each is based on a composition prepared by combining one or more chemical substances with water. Because of the cost of the chemical substances, it would be advantageous to be able to enhance the charge neutralization effects obtained with the chamical additives without increasing the amount of chemical substances employed.

Thus, there exists a need in the art for a process for enhancing the rate of discharge of static build-up. The process should be of relatively low cost to operate, fairly simple and safe to use without the need for costly equipment. The process should ideally be suited for use with existing air-wash systems in textile plants.

SUMMARY OF THE INVENTION

Accordingly, this invention aids in fulfilling these needs in the art by providing a process for neutralizing static electric charges on surfaces. The process consists essentially of contacting an atmosphere with at least one aqueous static charge composition by spraying an effective amount of the static charge composition into the atmosphere. The resulting treated atmosphere is contacted with a surface having static electric charge thereon. The static charge composition is prepared from substantially deionized water. The use of substantially deionized water increases the rate at which the static charge is neutralized as compared with the rate of neutralization produced under the same conditions but with a static charge composition prepared from water that has not been substantially deionized.

There are a number of advantages provided by this invention. The most important is the ability to reduce the cost of charge neutralization in commercial installations. The enhanced charge neutralization effect obtained by the use of deionized water makes it possible to use less of the static charge composition. The compositions are very easy to prepare by simply mixing the ingredients together. Since the compositions employed are usually in liquid form, it is particularly easy to automatically feed them into conventional air-washer systems. The process of this invention can be tailored to suit environments containing both negative and positive static electric charges of differing magnitudes. Static charges can be neutralized in a predictable, controllable and reproducible manner.

BRIEF DESCRIPTION OF THE DRAWING

This invention will be better understood by reference to the drawing in which the FIGURE is a diagrammatic illustration of the apparatus employed in the Examples set forth hereinafter.

DETAILED DESCRIPTION

The process of this invention involves treating atmospheres with certain compositions described more fully hereinafter, wherein a treated atmosphere is formed that is capable of neutralizing some or all of the positive and/or negative static electrical charges on objects with which the treated atmosphere comes in contact. Generally, the atmosphere will be air, although other atmospheres can be employed provided that the constituents of the atmosphere do not substantially chemically react with each other or with static charge compositions with which they are treated. Thus, for example, an inert gas atmosphere can be employed. Typical of the constituents in such an inert gas atmosphere are nitrogen and the noble gases, such as helium, neon, argon, krypton and zenon. The atmosphere can be comprised of a single element or compound or mixture of several elements and compounds. The term "atmosphere" is intended to include both gases and vapors. The atmosphere can be in the form of a stream into which the static charge composition is sprayed.

The spraying operation employed in this invention can be conducted in spray systems well known in the art. A number of spray systems are in commercial use. Typical of such systems are spray columns, cyclone sprayers, venturi air-washers, and jet scrubbers or washers. The spray system generally includes a spray nozzle or a series of spray nozzles, which can form, for example, a spray manifold. This invention is especially useful in air-washers of the type employed in textile plants.

As used herein, the term "spray nozzle" refers to the device for breaking into droplets the aqueous solution of this invention. Generally speaking, the spray nozzle can be a pressure nozzle, rotating nozzle (spinning atomizer) or a gas-atomizing nozzle (two fluid nozzle, pneumatic atomizer). Spray nozzles employed in air moistening, air washing, humidification, scrubbing and washing of gases are well known in the art. Typical examples of nozzles include solid-cone wide-angle sprayers, narrow-angle sprayers, hollow-cone sprayers, pressure atomizing spray nozzles, air- or gas-atomizing sprayers and rotating-disk sprayers.

The term "spraying" is to be understood as the process of dispersing a liquid in a gas or vapor, and the products obtained from such a process include sprays, mists and fogs. Essentially, the spraying operation employed in this invention involves the formation of a suspension or dispersion of minute particles or clusters of minute particles in a gas.

The treated atmosphere is obtained in the usual manner. For example, an atmosphere, such as an air stream, is contacted with a static charge composition by spraying an effective amount of the composition into the atmosphere.

The method of this invention can be practiced with any of the static charge compositions other than water. As used herein, the terms "static charge composition" means a substantially aqueous composition, other than water, which can be sprayed into an atmosphere so that the resulting treated atmosphere is capable of neutralizing negative static charges, positive static charges, or both negative and positive static charges on objects with which the treated atmosphere comes in contact. It will be understood that mixtures of static charge compositions can also be employed. Many suitable compositions are known in the art. Typical of the compositions are those described in the aforementioned patents. The principal difference between compositions employed in the present invention and the compositions of the aforementioned patents is that compositions employed in the present invention are prepared from deionized water to thereby make it possible to enhance the charge neutralization effects described more fully hereinafter.

As used herein, an "effective amount" of the static charge composition means that amount of the composition that will give the desired degree of static charge neutralization in the environment being treated, and will depend upon the nature of the static charge composition and the magnitude of the static charge in the environment. These amounts can be determined with a minimum of experimentation.

As used herein, the term "consisting essentially of" is to be given its generally accepted meaning as requiring that specified components be present, but not excluding unspecified conditions or materials that do not materially detract from the basic and novel characteristics of the invention and do not prevent the advantages of the invention from being realized.

This invention can be carried out with static charge compositions generally. A number of such compositions are known in the art. Though less effective than some of the other static charge compositions mentioned hereinafter, suitable static charge composition consists essentially of an aqueous solution comprising deionized water and about 500 to about 3000 ppm of a composition consisting essentially of borax and at least one surfactant selected from the group consisting of (a) a nonionic surfactant having an HLB number of 6.6, (b) a nonionic surfactant having an HLB number of 3.0, (c) a liquid, nonionic, fatty acid alkylolamide.

The borax and surfactant are present in the aqueous solution in a weight ratio of borax to surfactant of about 1.2:1 to about 15:1. Typically, the atmosphere is contacted with this aqueous solution for about 0.1 to about 10 seconds at a temperature between about 5° C. and the boiling point of the aqueous solution. The borax can be used in any of its technical and commercial grades. The term "HLB number" is used herein in its conventional sense as being an expression of the hydrophile-lipophile balance of the surfactant. It is a measure of the size and strength of the hydrophilic and the lipophilic group of the surfactant.

Another suitable static charge composition consists essentially of an aqueous solution comprising dionized water and at least one quaternary ammonium compound of the formula:

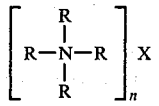

(I)

The R-groups in formula (I) can be identical to each other or different from each other. Typically, the concentration of quaternary ammonium compound in the aqueous solution is about 0.5 to about 20 ppm.

In one embodiment of this invention, each of the R-groups has the same number of carbon atoms and is selected from the group consisting of $C_3$ to $C_8$ substituted or unsubstituted aliphatic groups. The quaternary ammonium compound is soluble in water to an extent of at least about 0.5 ppm at about 20° C. If the R-groups contain too many carbon atoms, the water solubility of the quaternary ammonium compound may be adversely affected. This may require the use of auxiliary water miscible solvents in the preparation of an aqueous solution of the quaternary ammonium compound by first dissolving the quaternary ammonium compound in the water miscible solvent and then dissolving the resulting solution in water. The aliphatic groups can be branched or straight chain. It will of course be understood that the aliphatic groups can be stereoisomers. Preferably, the aliphatic groups are alkyl groups because of the ready availability of quaternary ammonium compounds containing such groups. Typical of such compounds are tetrabutyl ammonium chloride and tetrabutyl ammonium bromide, the latter compound being particularly preferred in this invention. The aliphatic group can also be unsaturated, for example, ethylenically unsaturated, in which case it would be expected that the solubility of the quaternary ammonium compound in water would be improved.

In another embodiment, each of the R-groups has the same number of carbon atoms and is selected from the group consisting of $C_3$ to $C_8$ substituted or unsubstituted cyclic groups. Typical of these groups are cycloaliphatic groups, such as cyclobutyl and cyclohexyl groups, cycloalkenyl groups, such as cyclohexene or cyclohexadiene groups, and aromatic groups, such as phenyl or benzyl groups.

In a further embodiment the R-groups are different. More particularly, one or two of the R-groups can be independently selected from $C_8$ to $C_{18}$ substituted or unsubstituted aliphatic or cyclic groups and the remaining R-groups are independently selected from substituted or unsubstituted $C_1$ or $C_2$ groups. Here again, there is wide latitude in selecting straight or branch chain, saturated or unsaturated aliphatic groups. Preferably, the aliphatic group is alkyl, but the aliphatic group can also contain unsaturation, such as ethylenic unsaturation. When one or more of the R-groups is cyclic, each will typically be cycloalkyl, cycloalkenyl or aromatic. Typical of the compounds within this class are n-alkyl benzyl ammonium halides, such as the chlorides and bromides. Preferred compounds within this group are mixtures of n-alkyl dimethyl benzyl ammonium chlorides and n-alkyl dimethyl ethylbenzyl ammonium chlorides in which the n-alkyl groups are mixtures of $C_{12}$ to $C_{18}$ alkyl groups. Particularly preferred are such compounds in which the n-alkyl of the dimethyl benzyl ammonium chloride is a mixture containing in weight percent about 60% $C_{14}$ groups, about 30% $C_{16}$ groups, about 5% $C_{12}$ groups and about 5% $C_{18}$ groups, and the n-alkyl of the dimethyl ethylbenzyl ammonium chloride is a mixture containing in weight percent about 50% $C_{12}$ groups, about 30% $C_{14}$ groups, about 17% $C_{16}$ groups and about 3% $C_{18}$ groups. These compounds are marketed under the trade name BARQUAT 4280Z by Lonza, Inc.

The value of n in formula (I) is 1, 2 or 3. This value is generally dictated by the valence of the anion X, which can be any inorganic anion, provided that the quaternary ammonium compound is soluble in water to an extent of at least about 0.5 ppm at about 20° C. Typical of suitable inorganic anions are halides, such as F, Cl, Br and I, sulfate, nitrate and phosphate. Chloride and bromide are preferred.

It will be understood that the R-groups can be substituted by hydrocarbons. For example, the R-groups can be aralkyl or alkaryl. While it is preferred that the R-groups in formula (I) be hydrocarbons, one or more of the R-groups can contain other substituents. For example, one or more of the R-groups can be substituted by at least one member selected from the group consisting of Cl, F, Br, I, OH, $NO_2$, $HSO_3$, $NH_2$—, NH— or an organic functional group, such as COOH—, CHO—, $$-\overset{O}{\overset{\|}{C}}-,\ -O-,\ -\overset{O}{\overset{\|}{C}}-NH_2,\ -C\equiv N \text{ and } -CNH_2 \text{ groups.}$$

When the R-groups are substituted, it is preferred that the substituents be predominantly hydrophobic.

Still another positive static charge composition is deionized water and dodecylbenzyl triethyl ammonium chloride in aqueous solution.

Another suitable static charge composition consists essentially of an aqueous solution consisting essentially of deionized water and at least one surfactant, other than a quaternary ammonium compound of formula (I). The surface tension of water against air at 20° C. is 72.5 dynes/cm, and the surfactant employed should be capable of being dissolved in such water to thereby form a surfactant solution having a surface tension against air of about 20 to about 60 dynes/cm at about 20° C. when the surfactant solution contains about 0.0005 to about 0.1 weight percent of the surfactants.

Typical of the surfactants that can be employed are polyoxyethylene compounds terminated at each end of the molecule by hydrophilic polyoxethylene groups. They can be represented by the simplified structure:

$$HO(CH_2CH_2-O)_a(\underset{\underset{CH_3}{|}}{CH_2}-CH_2-O)_b(CH_2CH_2-O)_cH.$$

A specific example of such surfactant is Pluronic L-62-LF, which is a condensate of ethylene oxide with a hydrophobic base formed by condensing propylene oxide with propylene glycol. It is a nonionic surfactant having an HLB number of 6.6 and a liquid available in 100 percent concentration.

Another suitable surfactant is a nonionic surfactant having an HLB number of 3.0. An example of a commercially available surfactant of this type is Pluronic L-61, which is similar in chemical structure to Pluronic L-62-LF. Pluronic L-61 is a liquid having a total average molecular weight of about 1950 and an average molecular weight of the polyoxypropylene base of about 1750. Pluronic L-62-LF is a liquid having an average molecular weight of about 2200, of which about 1750 comprises the polyoxypropylene base. Pluronic L-61 and Pluronic L-62-LF are available from Wyandotte Chemical Corporation.

Another suitable surfactant for use in this invention is an anionic sulfonate. An example of a commercially available surfactant of this type is Petro 22. Petro 22 is a sodium methyl naphthalene sulfonate available from Petro Chemical Company, Inc.

Other suitable surfactants are caprylic dicarboxylate imidazoline derivatives. Typical of such surfactants is Cycloteric MV-SF, which is an amphoteric surfactant available from Cyclo Chemicals Corp.

Other suitable surfactants include modified oxyethylated straight-chain alcohols, such as Plurafac RA-10, which is a nonionic surfactant available from BASF Wyandotte Industries Chemicals Group.

A particularly preferred surfactant for use in this invention is comprised of a mixture of Cycloteric MV-SF and Plurafac RA-10 in a weight ratio of 3:2.

The amount of surfactant employed is generally about 0.5 to about 50 ppm.

It is also possible to employ mixtures of treated atmospheres in practicing the process of this invention. For example, a treated second atmosphere can be combined to form a mixed atmosphere. If the mixed atmosphere comes in contact with an object that has a positive or negative static electrical charge, the magnitude of the static charge will be substantially reduced and can even be completely neutralized. It is also possible to simultaneously neutralize positive and negative static charges on objects. This is particularly advantageous in the textile industry in which processing operations can give rise to both positive and negative static electrical charges. Of course, deionized water is used in the preparation of at least one of the compositions used to treat the atmospheres.

Another static charge composition capable of simultaneously neutralizing both positive and negative static charges on objects comprises an aqueous solution consisting essentially of deionized water about 0.5 to about 20 ppm of at least one quaternary ammonium compound of the Formula (I) and a surfactant. The aqueous solution contains about 0.5 to about 50 ppm of at least one surfactant capable of being dissolved in water, which has a surface tension of about 72.75 dynes/cm at 20° C., to thereby form a surfactant solution having a surface tension of about 20 to about 60 dynes/cm at 20° C. when the surfactant solution contains about 0.0005 to about 0.1 weight percent of the surfactant. The surfactant and quaternary ammonium compound are in a weight ratio of surfactant:quaternary ammonium compound of about 1:1 to about 10:1. The resulting atmosphere after treatment with the aqueous solution is capable of simultaneously neutralizing positive and negative static charges on objects with which the treated atmosphere comes in contact.

The method of this invention can also be employed for simultaneously neutralizing positive and negative static electric charges on surfaces using mixed atmosphers. For example, a first atmosphere is contacted with a positive static charge composition by spraying an effective amount of the composition into the atmosphere. A second atmosphere is contacted with a negative static charge composition by spraying an effective amount of the negative static charge composition into the second atmosphere. The resulting treated first atmosphere is mixed with the resulting treated second atmosphere to thereby form a mixed atmosphere, and at least one surface having positive and negative static electric charges thereon is contacted with the mixed atmosphere to thereby simultaneously neutralize positive and negative static charges on the surface. The use of deionized water in the static charge compositions enhances the rate of charge neutralization.

The water employed in practicing the process of this invention is substantially deionized. Deionization can be carried out using conventional techniques, such as by ion-exchange, distillation and chemical precipitation. Ion-exchange is preferred because of the speed and availability of such processes for water treatment. Typically, a suitable zeolite, cation exchange resin or anion exchange resin will be chosen depending upon the characteristics of the water to be treated.

One way of carrying out this invention is described in detail below with reference to the FIGURE. In the following Examples, all parts, proportions, percentages and ratios are by weight unless otherwise indicated.

DESCRIPTION OF THE TEST PROCEDURE AND APPARATUS

In the FIGURE, an air-washer apparatus 1 is a Lester Ion Generator/Humidifier Model No. 10 available from Lester Laboratories, Inc., 2370 Lawrence Street, Atlanta, Ga. 30344. Air-washer 1 comprises an air-washing chamber 2 formed by a tank 3. The tank 3 has an inlet opening 4 at the top and outlet pipes 5 and 6 near the middle of tank 3. Air (heavy arrow) enters inlet 4 and is blown under positive pressure into chamber 2 via fan 10 and pipe 11.

A sump generally indicated as 7 is provided as part of air-washer 1. The sump contains eleven liters of a static charge composition to be sprayed into chamber 1. A tube (not shown) is submerged in the static charge composition and extends to a submersible pump (not shown), which pumps the composition from sump 7 up to an internal spraytree system terminating in four spray nozzles 8, two of which are visible in the FIGURE.

Pipes 5 and 6 can be provided with an anti-carry-over baffle that removes entrained liquid carried over from spray 9 in chamber 2. Pipes 5 and 6 are connected to outlet pipe 12 by A T-connector 13. Near the open end 14 of the pipe 12 is located an aluminum plate 15, which is 10 cm by 17 cm and about 20GA thick. Plate 15 is supported via a styrofoam block 16. A Keithley Model 610B electrometer 17 is used to monitor the charge on the plate 15 via a static probe 18 positioned approximately ¼ inch from the plate surface. The electrometer 17 is supported on styrofoam blocks in order to isolate the meter. An electrical charge is placed on aluminum plate 15 by means of a 1000 v. power supply (not shown) having positive (+) and negative (−) terminals. This is accomplished by contacting aluminum plate 15 with a probe connected to the power supply. The power supply can also be isolated from the surroundings by supporting it on styrofoam blocks. The electrical apparatus is grounded to a water-pipe to minimize the effects of stray currents.

During operation, the system is activated by starting the pump which recirculates the static charge composition in sump 7 to the spray nozzles 8. Fan 10 is started, and air is blown into chamber 2 via pipe 11. Laminar flow of the atmosphere into which the solution is sprayed is preferred. The air contacts the spray 9 from nozzles 8 in chamber 2 thereby forming a treated atmosphere, which exits air-washer 1 via pipes 5, 6 and 12. Droplets of spray 9 fall into sump 7 for recirculation to the spray nozzles.

In the following Examples, the sump 7 was charged with the aqueous solution indicated in the respective Example, and the fan 10 and pump are started. Plate 15 was initially grounded by touching it while the electrometer 17 was zeroed to center scale. The power supply was then used to charge the plate 15 either positive or negative, as desired (up to 1000 volts). A reading of 5 indicates full scale deflection on the electrometer. The change in the reading on the electrometer 17 was then observed for a period of 60 seconds and the readings recorded at 10 second intervals. These measurements give an indication of the rate of discharge of the electrical charge on plate 15. At the end of each 60 second run, the plate 15 was grounded so that any meter drift could be observed; these are reported as ground values.

The temperature of the solution sprayed into the air stream in each case was about 21° C., unless otherwise indicated. The water used in all of the Examples was either tap water from the public water supply of the city of East Point, Ga., or deionized water. The deionized water was prepared by passing the tap water through a commercially available mixed bed deminerializer column (Scientific Products #D 5062-3 mixed bed cartridge).

EXAMPLE 1

Air Washer with Tap Water

This is a comparative example using tap water in the air washer.

When tap water alone was added to the sump 7 and plate 15 alternately charged positive and negative, the following electrometer readings were made.

TABLE 1

| TIME | CHARGE ON PLATE | |
|---|---|---|
| (Seconds) | Negative | Positive |
| 0 | 5.0 | 5.0 |
| 10 | 5.0 | 2.7 |
| 20 | 5.0 | 1.4 |
| 30 | 5.0 | 0.6 |
| 40 | 5.0 | 1 |
| 50 | 5.0 | |
| 60 | 4.8 | |

These results indicate that a spray of tap water functions as a negative static charge composition by dissipating a positive charge on plate 15 much faster than a negative charge. In fact, it is seen that a spray of tap water alone was relatively ineffective in neutralizing a negative electrical charge in a short period of time.

EXAMPLE 2

Air Washer with Deionized Water Quaternary Ammonium Compound

Example 1 was repeated, except that an aqueous solution containing 0.5 ppm tetrabutyl ammonium bromide (TBAB) in deionized water was added to the sump. The following results were observed.

TABLE 2

| TIME (Seconds) | CHARGE ON PLATE Negative | Positive |
|---|---|---|
| 0 | 5.0 | 5.0 |
| 10 | 1.0 | 4.5 |
| 20 | 0.4 | 4.1 |
| 30 | 0 | 3.7 |
| 40 | | 3.7 |
| 50 | | 3.7 |
| 60 | | 3.6 |
| Ground Value | Very Positive | |

TBAB reversed the behavior of a system based on water alone. TBAB in water neutralized a negative charge on the plate more rapidly than it neutralized a positive charge. While the plate became very positive at the end of the first run, this may have been due to the plate picking up excess charge from the air stream.

EXAMPLE 3

Air Washer with Deionized Water, TBAB and Surfactant

Example 1 was repeated, except that 0.5 ppm TBAB and 1.5 ppm Petro 22 were added to the sump. The following results were observed.

TABLE 3

| TIME (Seconds) | CHARGE ON PLATE Negative | Positive |
|---|---|---|
| 0 | 5.0 | 5.0 |
| 10 | 2.0 | 3.7 |
| 20 | 0.8 | 2.9 |
| 30 | 0.3 | 2.4 |
| 40 | 0 | 2.0 |
| 50 | | 1.8 |
| 60 | | 1.7 |

Furthermore, as the amount of Petro 22 was increased, the behavior of the treated air stream toward a negatively charged plate was diminished, while the ability of the treated air stream to discharge a positively charged plate was increased. The following data based on runs at 0.5 ppm TBAB and 2.0 ppm Petro 22 in deionized water illustrate this trend.

TABLE 4

| TIME (Seconds) | CHARGE ON PLATE Negative | Positive |
|---|---|---|
| 0 | 5.0 | 5.0 |
| 10 | 3.3 | 2.8 |
| 20 | 2.3 | 1.5 |
| 30 | 1.6 | 0.6 |
| 40 | 1.2 | 0.2 |
| 50 | 0.9 | 0 |
| 60 | 0.8 | |
| Ground Value | 0.4 | |

The same static charge composition as reported in Table 4 gave the following results after 20 minutes continuous operation in the system shown in the FIGURE.

TABLE 5

| TIME (Seconds) | CHARGE ON PLATE Negative | Positive |
|---|---|---|
| 0 | 5.0 | 5.0 |
| 10 | 2.9 | 3.4 |
| 20 | 1.7 | 2.3 |
| 30 | 1.0 | 1.6 |
| 40 | 0.6 | 1.2 |
| 50 | 0.3 | 0.8 |
| 60 | 0.2 | 0.6 |
| Ground Value | 0.2 | |

While the operation of this invention has been demonstrated with one air-washer, it will be understood that more than one air-washer can be utilized. Similarly, while the invention has been described herein as based on one atmosphere, it will be understood that a multiplicity of atmospheres can be employed by treating at least one of the atmospheres with a static charge composition based on deionized water.

In practicing the process of this invention, the amount of static charge composition sprayed into each respective atmosphere can be varied over a wide range as previously described. The amount of each composition sprayed can be up to the saturation point of the atmosphere into which it is sprayed, the saturation point being the point at which no more of the sprayed composition can be carried by the flowing atmosphere. Beyond the saturation point, objectionable deposits of the compositions on surfaces may be encountered.

The static charge compositions can include other additives that do not materially detract from the ability to neutralize positive and negative static electric charges. Typical of optional additives are antifoaming agents; corrosion inhibitors; anti-oxidants; chelating agents; colorants, such as dyes and pigments; buffering agents; lubricants; anti-bacterial and anti-fungal agents; odor neutralizers; and small amounts of organic solvents.

The applications for the process of this invention will be immediately apparent to persons skilled in the art of static control. Relatively large and troublesome amounts of static electricity are frequently generated in textile and paper processing. The method and composition of this invention can be employed to substantially reduce or completely neutralize positive and negative static electrical charges in such environments. This invention is suitable for use with air-washer equipment of the type conventionally employed in such installations. Thus, this invention is particularly advantageous since additionally costly equipment is frequently not required.

I claim:

1. A process for neutralizing a static electric charge on a surface, said process consisting essentially of contacting an atmosphere with a least one aqueous static charge composition by spraying an effective amount of said static charge composition into said atmosphere, and contacting the resulting treated atmosphere with a surface having static electric charge thereon, to thereby neutralize at least a portion of said charge, wherein said static charge composition is prepared from substantially deionized water to thereby increase the rate at which said charge is neutralized when compared with the rate of neutralization produced under the same conditions but with a static charge composition prepared from water that has not been substantially deionized.

2. Process according to claim 1 wherein said atmosphere is selected from the group consisting of air, nitrogen, noble gases and mixtures thereof.

3. Process according to claim 2 wherein said static charge composition is an aqueous solution consisting essentially fo tetrabutyl ammonium bromide in substantially deionized water.

4. Process according to claim 2 wherein said static charge composition is an aqueous solution consisting essentially of dodecylbenzyl triethyl ammonium chloride in substantially deionized water.

5. Process according to claim 2 wherein said static charge composition is an aqueous solution consisting essentially of substantially deionized water and about 500 to about 3000 ppm of a composition comprising (1) borax, and (2) a surfactant selected from the group consisting of (a) a nonionic surfactant having an HLB number of 6.6, (b) a nonionic surfactant having an HLB number of 3.0, and (c) a liquid, nonionic fatty acid alkylolamide; the weight ratio of borax to surfactant being about 1.2:1 to about 15:1.

6. Process according to claim 2 wherein said static charge composition is an aqueous solution consisting essentially of substantially deionized water and about 0.5 to about 20 ppm of at least one quaternary ammonium compound of the formula

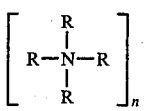

X wherein (1) each of the R-groups is the same and is selected from the group consisting of $C_3$ to $C_8$ substituted or unsubstituted aliphatic or cyclic groups; or (2) one or two of the R-groups are independently selected from $C_8$ to $C_{18}$ substituted or unsubstituted aliphatic or cyclic groups and the remaining R-groups are independently selected from substituted or unsubstituted $C_1$ to $C_2$ groups;

X is an inorganic anion; n equals 1, 2 or 3; said quaternary ammonium compound being soluble in water to an extent of at least about 0.5 ppm at about 10° C.

7. Process according to claim 6 in which each of said R-groups is a branched or straight chain aliphatic group.

8. Process according to claim 6 wherein at least one of said R-groups is an unsaturated alkyl group.

9. Process according to claim 6 wherein at least one of said R-groups is a saturated alkyl group.

10. Process according to claim 6 in which at least one of said R-groups is substituted by at least one member selected from the groups consisting of Cl, F. Br, I, OH, $NO_2$, $HSO_3$, $NM_2$—, NH, COOH-, CHO-, $$-\overset{O}{\overset{\|}{C}}-,\ -O-,\ -\overset{O}{\overset{\|}{C}}-NH_2,\ -C\equiv N,\ -CNH_2 \text{ groups}$$

and in which said quaternary ammonium compound is capable of forming micelles in aqueous solution.

11. Process according to claim 6 wherein at least one of said R-groups is a substituted or unsubstituted aryl group.

12. Process according to claim 6 wherein each of the R-groups is identical.

13. Process according to claim 6 in which X is a chloride, fluoride, bromide, iodide, sulfate, nitrate or phosphate ion.

14. Process according to claim 2 wherein said static charge composition is an aqueous solution consisting essentially of substantially deionized water and about 0.5 to about 50 ppm of at least one surfactant capable of being dissolved in water having a surface tension against air of about 72.75 dynes/cm at 20° C. to thereby form a surfactant solution having a surface tension against air of about 20 to about 60 dynes/cm at 20° C. when said surfactant solution contains about 0.0005 to about 0.1 weight percent of said surfactant.

15. Process according to claim 14 in which said surfactant is selected from the group consisting of (a) a nonionic surfactant having an HLB number of 6.6, (b) a nonionic surfactant having an HLB number of 3.0, (c) an amphoteric caprylic dicarboxylate imidazoline derivative surfactant, (d) a nonionic modified oxyethylated straight chain alcohol surfactant, and (e) an anionic sodium sulfonate.

16. Process according to claim 14 in which said surfactant is comprised of a mixture of (a) an amphoteric caprylic dicarboxylate imidazoline derivative surfactant, and (b) a nonionic modified oxyethylated straight chain alcohol surfactant.

17. Process according to claims 1, 3, 5, 6, 14, 15 or 16 in which said treated atmosphere is in laminar flow.

18. Process according to claim 1 in which said atmosphere is comprised of a multiplicity of gaseous streams into which static charge compositions are sprayed.

* * * * *